United States Patent [19]

Gaskins

[11] 4,000,971

[45] Jan. 4, 1977

[54] LIQUID APPLYING MEANS

[76] Inventor: Thomas Gaskins, Palmdale, Fla. 33944

[22] Filed: Feb. 3, 1976

[21] Appl. No.: 654,789

[52] U.S. Cl. ..... 21/63; 21/7; 47/24; 239/379

[51] Int. Cl.[2] ..... B27K 3/02

[58] Field of Search ..... 239/379; 150/52 R; 47/24, 57.5; 222/185; 43/126; 21/62, 63, 7; 427/445

[56] References Cited

UNITED STATES PATENTS

| | | | |
|---|---|---|---|
| 989,325 | 4/1911 | Bremer | 47/24 UX |
| 1,974,156 | 9/1934 | Hockmeyer | 150/52 R |
| 2,217,557 | 10/1940 | MacFee | 47/24 UX |
| 2,778,398 | 1/1957 | Edwards | 150/52 R |

FOREIGN PATENTS OR APPLICATIONS

| | | | |
|---|---|---|---|
| 913,644 | 9/1946 | France | 47/24 |

*Primary Examiner*—Evon C. Blunk
*Assistant Examiner*—Michael Mar
*Attorney, Agent, or Firm*—Mason, Fenwick & Lawrence

[57] ABSTRACT

A liquid applicator for treating posts, etc. has a plastic support panel to which a flexible plastic sheet is bonded along side and bottom portions to define a pouch in which liquid is contained for discharge through openings in the flexible plastic sheet to flow downwardly onto the surface of the post or other member on which the device is positioned; in a second embodiment, a plurality of pouch members are formed from a unitary flexible sheet bonded to an elongated support panel which is capable of being rolled or otherwise stored and cut to length for use in completely encircling posts, trees or the like for slowly applying liquid thereto.

9 Claims, 5 Drawing Figures

10
12
14
16
18
20
22
23
24
26
27
27'
28
30
32
34
36
40
41
42
50
52
54
56
60
70
72
80
82
84
90
3

LIQUID APPLYING MEANS

This invention is in the field of liquid dispensing apparatus and is particularly directed to the field of apparatus for providing a continuous measured flow of treatment liquid to a desired area such as a post or other structural member into which the treatment liquid is absorbed. The subject invention is capable of use in conjunction with the application of insecticides or other liquid treatment materials such as preservatives in the form of creosote or the like to wooden structural members such as posts, piers, pilings, building frame components or practically any form of wooden structural member.

It has been conventional practice for many years to apply liquid treatment such as preservative materials to posts and the like by the use of heated pressure chambers in a mill in which the posts are subjected to liquid pressure which forces the liquid into the cellular structure of a wooden member. However, the application of preservatives or insecticides to wooden members in the field or forming part of a standing structure has been difficult due to the fact that wooden members absorb liquid quite slowly at ambient pressures and temperatures and a great deal of time is required in order to achieve sufficient liquid absorption to effectively treat the wooden member.

Under the circumstances, the substantial amount of time required for the treatment of material to seep into the wood requires that the treatment material must be applied, at the expense of substantial labor, by a brush or the like on numerous successive occasions in order to achieve adequate and effective treatment. Moreover, the rate at which wood will absorb liquid treatment material varies as the treatment period progresses since the initially dry members absorb a great deal more treatment liquid than to the same members at later stages of the treatment process after they have absorbed a substantial amount of treatment liquid.

Therefore, it is the primary object of this invention to provide a new and improved means for applying liquid treatment material to posts and other wooden members.

Another object of the invention is the provision of a new and improved means for applying preservatives to wooden work members or the like continuously at a controlled rate over a substantial period of time with minimum labor and expense.

Yet another object of the invention is the provision of a new and improved means for applying liquid treatment material for a given time period with the rate of liquid treatment material application decreasing toward the end of the treatment period.

Obtainment of the foregoing and other objects of the invention is enabled by the first embodiment of the invention which includes a plastic flat support panel which can be secured by nails or other suitable support means to the side of a post. A flexible sheet member is bonded to the outer face of the support panel so as to bulge outwardly and define a pouch-like liquid storage space between the sheet member and the support panel in which the treatment liquid can be provided. Apertures are provided in the flexible sheet member so that liquid treatment material contained within the storage space between the flexible sheet member and the flat support panel is gradually dispensed outwardly for gravitational deposit on the area of the post below the flexible sheet member. As the liquid level in the pouch-like storage space drops, the number of apertures in the flexible sheet member through which the liquid treatment material can flow obviously decreases so that the rate of treatment material discharge decreases toward the terminal portion of a liquid application process so as to keep the rate of liquid application within the capacity of the wood to absorb the liquid.

The flexible sheet member can be folded inwardly adjacent the flat support member for storage purposes but can bulge outwardly to provide a pouch-like volumetric liquid storage space when the device is in use. In the first embodiment, single pouch-like dispensing units are provided while in the second embodiment, a continuous strip of plastic comprises the support member with the flexible sheet member being bonded to the base of the flat support member along its length to provide a plurality of pouch-like liquid storage chambers. The last-mentioned embodiment can be cut to any desired length so as to be fittable about the entire periphery of a pole or the like and provides the dispensing of liquid about the entire periphery of the pole.

A better understanding of the manner in which the preferred embodiments of the invention achieve the objects of the invention will be enabled when the following written description is considered in conjunction with the appended drawings in which.

Figures 1, 2, 3, 4, 5:
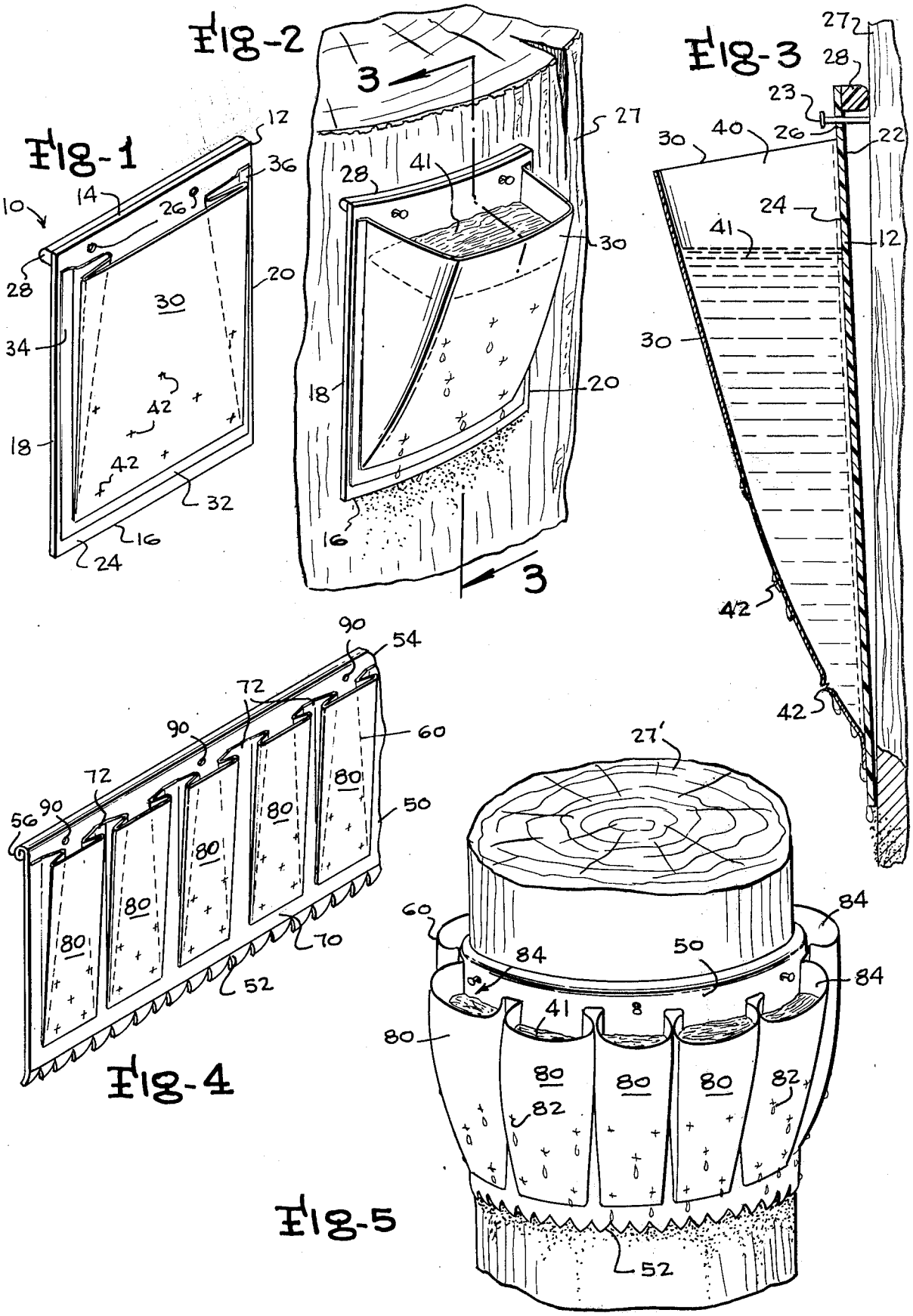
FIG. 1 is a perspective view of the first embodiment of the invention in a folded non-use or storage condition.
FIG. 2 is a perspective view of the first embodiment of the invention in use as attached to the side of a post for dispensing liquid onto the surface of a post.
FIG. 3 is a sectional view taken along lines 3—3 of FIG. 2.
FIG. 4 is a perspective view of a second embodiment of the invention in a storage or inactive condition.
FIG. 5 is a perspective view of the second embodiment of the invention attached to a post for dispensing liquid treatment material thereon.

The first embodiment of the invention, generally designated 10, is directed to a single storage unit device having a single liquid storage compartment which is supported by a generally flat rectangular support panel 12 formed of plastic or the like. Support panel 12 is defined by an upper edge 14, a lower edge 16, first and second side edges 18 and 20 and an inner face 22 and an outer face 24 as best illustrated in FIG. 3. A pair of openings 26 extend through the support panel 12 for enabling attachment of the flat support panel by nails 23 to a vertically extending wooden structural member such as a post or the like 27. A spacer member 28 is connected to the upper portion of the inner face 22 for positioning the support panel 12 away from the post 26 with the exception of the lower end portion of the support panel as shown in FIG. 3.

A flexible plastic sheet 30 is bonded to the outer face 24 of the flat support panel 12 along a lower horizontal bond area 32 and two side bond areas 34 which cooperates to define a unitary U-shaped leak-proof bonded connection effected by heat seal means or adhesively between the flexible plastic sheet 30 and the flat support panel 12.

The flexible plastic sheet 30 is movable between a flat or storage position illustrated in FIG. 1 and an extended position illustrated in FIGS. 2 and 3 in which the flexible sheet assumes a pouch-like configuration defining a volumetric space 40 in which a quantity of liquid 41 can be stored for dispensing outwardly of the pouch member through a plurality of openings 42 extending through the wall of the pouch member. Consequently, the liquid 41 stored within the volumetric space 40 is discharged through the openings 42 to flow downwardly onto the area of the post beneath the lower extent of the support panel 12 in a manner best illustrated in FIG. 2. As the liquid 41 in the volumetric space 40 gradually falls, the number of openings 42 with which the liquid is in flow relationship obviously decreases so that the rate of liquid dispensing decreases with the progress of time so as to broadly coincide with the decrease in the absorbability of the wood caused by the previous absorption of the liquid.

FIGS. 4 and 5 illustrate a second embodiment of the invention which is closely similar to the first embodiment but which can be formed in the form of an elongated roll which can be cut to a desired length to effect mounting of the cut length about the entire periphery of the pole in the manner illustrated in FIG. 5.

More specifically, an elongated plastic support panel 51 is provided with a lower serrated edge portion 52, an upper edge portion 54 and an inner and outer face in the manner of the first embodiment. A flexible plastic sheet 60 is bonded to the outer face of the support panel 50 along a lower horizontal bond area 70 and a plurality of vertical bond areas 72 so as to define a plurality of pouch-like members 80 between the adjacent vertically extending bonded areas 72. The members 80 fold outwardly from fold lines on each side of each of the pouch-like members to provide a plurality of volumetric spaces 84 in which liquid 41 is provided in the same manner as in the first embodiment.

FIG. 5 illustrates employment of the second embodiment with the device completely encircling a post 27' so that the liquid 41 in spaces 84 is dispensed outwardly through openings 82 in the pouch member in the same manner as liquid is dispensed through the openings 42 of the first embodiment. The pouch-like members 80 are movable between a folded position illustrated in FIG. 4 and the open condition illustrated in FIG. 5 with the elongated structure being rollable into rolls or the like for storage purposes.

The serrated lower edge 51 of the support panel 50 is of particular value in effecting a uniform discharge of liquid along the entire lower edge portion of the device particularly in circumstances in which the device might become canted with respect ot the horizontal. In such cases, if it were not for the serrated edge 52, the liquid would flow along the lower edge of panel 50 in the lowermost corner of the canted structure. The upper end of the support member 50 is rolled as shown at 56 to provide a spacing means performing the same function as the spacer means 28 of the first embodiment and openings 90 are provided to receive nails 92 to permit the device to be hung on post 27'.

It should be understood that both embodiments of the invention, while preferably formed of plastic materials, can also be formed of other materials such as waterproof paper or the like.

Numerous other embodiments not departing from the spirit and scope of the invention will undoubtedly occur to those skilled in the art, and it should be understood that the invention is to be limited solely by the appended claims.

I claim:

1. Liquid applying means for slowly applying treatment liquid to wooden structural members or the like, said liquid applying means comprising a generally flat support panel having an inner face engageable with the outer surface of a structural member, said flat support panel also having an outer face, an upper edge and a lower edge, attachment means for enabling said support panel to be attached to and supported by such a structural member above a treatment area of the structural member to which it is desired to apply treatment liquid, flexible sheet member means, means bonding said flexible sheet member means to said outer face of said support panel so that said flexible sheet member defines at least one pouch-like member movable between a first position in which it abuttingly engages the outer face of said flat support panel and an extended position in which said flexible pouch-like member bulges outwardly from the outer face of said flat support panel so as to define at least one opentopped volumetric space between said flexible sheet member and said flat support panel in which liquid can be received and stored and liquid discharge openings in said flexible sheet member for permitting liquid in said volumetric space to be gradually discharged through said liquid discharge openings for gravitational flow down the outer surface of said flexible sheet for deposit on the treatment area of said structural member.

2. The invention of claim 1 wherein said flat support panel comprises a plastic sheet of generally rectangular configuration.

3. The invention of claim 1 wherein said flat support panel comprises a plastic sheet of generally rectangular configuration and said flexible sheet means comprises a flexible plastic sheet bonded to said flat support panel along side and bottom edges of said flexible plastic sheet.

4. The invention of claim 1 wherein said flat support panel comprises a plastic sheet of generally rectangular configuration and said flexible sheet means comprises a flexible plastic sheet bonded to said flat support panel and additionally including spacer means extending from the inner face of said flat support panel for spacing the upper portions of the support panel away from a structural member on which said support panel is supported by said attachment means.

5. The invention of claim 1 wherein said flat support panel comprises a plastic sheet of generally rectangular configuration and said flexible sheet means comprises a flexible plastic sheet bonded to said flat support panel along top, bottom and side edges of said flexible plastic sheet and additionally including spacer means extending from the inner surface of said flat support panel for spacing the upper portions of the support panel away from a structural member on which said support panel is supported by said attachment means.

6. The invention of claim 3 wherein the lower edge of said flat support panel is serrated.

7. The invention of claim 3 wherein said flexible plastic sheet is bonded to said flat support panel along a bottom horizontal edge portion, and by a plurality of approximately vertical portions so as to define a plurality of pouchlike members.

8. The invention of claim 7 wherein the lower edge of said flat support panel is serrated.

9. The invention of claim 8 wherein the upper edge portion of said flat support panel includes spacer means for positioning the inner surface of the upper portion of said support panel from said structural member.

* * * * *